US010260257B2

(12) United States Patent
Parsons et al.

(10) Patent No.: US 10,260,257 B2
(45) **Date of Patent: *Apr. 16, 2019**

(54) FORGED FRAME HANDCUFFS

(71) Applicant: Armament Systems and Procedures, Inc., Appleton, WI (US)

(72) Inventors: Kevin Parsons, Appleton, WI (US); Siu Ngai Wang, Kowloon (HK)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/649,191

(22) Filed: Jul. 13, 2017

(65) Prior Publication Data

US 2018/0119460 A1 May 3, 2018

Related U.S. Application Data

(63) Continuation-in-part of application No. 15/337,967, filed on Oct. 28, 2016.

(60) Provisional application No. 62/463,778, filed on Feb. 27, 2017.

(51) Int. Cl.
*E05B 75/00* (2006.01)
*E05B 15/16* (2006.01)

(52) U.S. Cl.
CPC ..... *E05B 75/00* (2013.01); *E05B 15/16* (2013.01)

(58) Field of Classification Search
CPC ..... E05B 75/00; E05B 15/16; B21K 23/00; B21J 5/025
USPC ..... 70/16, 15, 17–19; 24/16 PB; 119/816, 119/819; 128/878, 879
See application file for complete search history.

(56) References Cited

U.S. PATENT DOCUMENTS 647,736 A * 4/1900 Widmayer
1,456,846 A * 5/1923 Gamwell ..... E05B 75/00 70/16
1,872,857 A * 8/1932 Wesson ..... E05B 75/00 70/16
1,881,577 A * 10/1932 Hillyard ..... E05B 75/00 70/16
3,146,614 A * 9/1964 Von Frantzius ..... E05B 75/00 70/16
3,179,143 A * 4/1965 Schultz ..... F16B 39/225 156/310
3,616,665 A * 11/1971 Rosenthal ..... E05B 75/00 70/16
4,089,195 A * 5/1978 Lai ..... E05B 75/00 361/232
4,314,466 A * 2/1982 Harris ..... E05B 75/00 70/16
4,840,048 A * 6/1989 Elam ..... E05B 75/00 70/16
4,909,051 A * 3/1990 Lee ..... E05B 75/00 128/878
5,007,257 A * 4/1991 Thompson ..... E05B 75/00 224/914
5,138,852 A * 8/1992 Corcoran ..... E05B 75/00 70/16
5,233,848 A * 8/1993 Elam ..... E05B 75/00 70/16

(Continued)

*Primary Examiner* — Lloyd A Gall
(74) *Attorney, Agent, or Firm* — Hahn Loeser & Parks, LLP

(57) ABSTRACT

Forged frame handcuffs are described, including a lighter but stronger rigid pair of handcuffs that includes integral side plates.

12 Claims, 12 Drawing Sheets

(56) References Cited

U.S. PATENT DOCUMENTS

| | | | | | |
|---|---|---|---|---|---|
| 5,526,658 | A * | 6/1996 | Cross | E05B 75/00 | 70/16 |
| 5,613,381 | A * | 3/1997 | Savage | E05B 75/00 | 70/16 |
| 5,799,514 | A * | 9/1998 | Tobin, Jr. | E05B 75/00 | 70/16 |
| 6,311,529 | B1 * | 11/2001 | Kang | E05B 75/00 | 70/16 |
| 6,886,374 | B2 * | 5/2005 | Clifton, Jr. | E05B 75/00 | 70/16 |
| 7,010,943 | B1 * | 3/2006 | Earl | E05B 75/00 | 70/16 |
| 7,062,943 | B2 * | 6/2006 | Parsons | E05B 75/00 | 70/16 |
| 7,284,399 | B1 * | 10/2007 | Sisco | E05B 75/00 | 119/816 |
| 7,950,885 | B2 * | 5/2011 | Rosenkranz | F16B 25/0026 | 411/258 |
| 8,635,750 | B1 * | 1/2014 | Ginocchio | H02G 3/32 | 24/272 |
| 8,839,796 | B2 * | 9/2014 | Reese | E05B 75/00 | 128/875 |
| 2001/0013235 | A1 * | 8/2001 | Trempala | A62C 35/68 | 70/169 |
| 2004/0216501 | A1 * | 11/2004 | Clifton, Jr. | E05B 75/00 | 70/16 |
| 2005/0097929 | A1 * | 5/2005 | Anderson | E05B 75/00 | 70/16 |
| 2007/0256461 | A1 * | 11/2007 | Parsons | E05B 75/00 | 70/16 |
| 2010/0206017 | A1 * | 8/2010 | Garibaldi | E05B 75/00 | 70/16 |

* cited by examiner

FORGED FRAME HANDCUFFS

FIELD OF THE INVENTION

The invention generally relates to personal restraints and, in a specific example, handcuffs.

BACKGROUND

Heretofore, a large number of handcuff designs have been proposed and manufactured. Prior art handcuffs are typically known to be heavy and include a cheek plate assembly made of metal plates which are cut to a desired shape and riveted together such that rivet heads protrude from the sides of the cheek assembly. In view of the rivet heads protruding from the cheek plate assembly, it may be difficult to align the cuffs and to fold the cuffs flat.

In conventional handcuffs, the swivel connection to chain links is typically the weakest part of the handcuff when subjected to lateral pressure.

Further, in conventional handcuffs, the lock mechanism is subject to damage such as the breaking off of key posts or pins, chipped teeth, fatigued springs, sticking of double-lock bars, rusting and clogging with debris. Such damage typically requires complete replacement of the handcuffs.

Conventional handcuffs typically only have one keyway in the cheek plate assembly such that a user of the handcuffs has to be trained to always have the keyway up for inserting the key.

Often times, the cheek plates and/or the bow of the handcuff have edges along the inside of the curved surface of the bow or cheek plates which can cause trauma or injury to a wrist. This medical injury is common and known as handcuff neuropathy. Also, the curved envelope of the bow and the curved envelope of the cheek plates in conventional handcuffs often do not properly fit many wrists and sometimes are not large enough or small enough.

Many of the above-noted disadvantages of conventional handcuffs were overcome with the handcuff design of U.S. Pat. No. 7,062,943 to Parsons et al. ("Parsons '943"), which is incorporated by reference. Parsons '943 disclosed a unitized cheek frame that is die-stamped from a metal plate, and then formed into cheek arms, which are overmolded with a polymer. The construction and arrangement of the unitized frame allows for the lockset to be removable for repair and/or replacement. The lock set further includes a keyway that is accessible from either side of each handcuff.

Despite the advantages set forth above, the unitary die-stamped construction of Parsons '943 may result in undesirably flexible cheek plates, which allows for misalignment of the handcuff bow with the cheek plate base and lock mechanism. Such a misalignment may prolong efforts to handcuff a subject in the field. The stamped steel cores of the cheek arms may be bent or otherwise damaged if misused. Additionally, the stamped steel construction requires a plastic over-molding step to provide appropriate radiuses on the cheek arms to avoid tissue damage in use.

SUMMARY

As will be described in greater detail hereinafter, the handcuffs of the present invention retain many of the beneficial aspects of Parsons '943, but with high strength and relatively light weight with forged alloy cheek plates. This results in improved strength and rigidity, improving use of the handcuffs in the field.

Some embodiments include a first forged cheek frame half including a first cheek arm and a first lockset cavity portion and a second forged cheek frame half including a second cheek arm and a second lockset cavity portion. When the first and second forged cheek frame halves are combined, the first and second lockset cavity portion combine to form a lockset cavity between the first and second cheek frame halves. A bow having outwardly facing teeth along a portion of the bow is rotatably fastened to the first and second cheek arms. A removable lock mechanism disposed within the lockset cavity, the lock mechanism comprising movable pawls corresponding to the teeth, wherein the pawls releasably engage the teeth when the bow is rotated into engagement with the lock mechanism.

In a preferred embodiment, each forged cheek frame half is forged aluminum alloy. For example, each forged cheek frame half may be die forged from a bar of 7075 aluminum alloy. Preferably, each forged cheek frame half is hard coat anodized.

The first forged cheek frame half may be fastened to the second forged cheek frame half with a plurality of spiral pins. The spiral pins may be set in threadlocking compound to improve security.

To form a pair of handcuffs, the first and second forged cheek frame halves may further comprise a plurality of semi-annular recesses such that when the first and second forged cheek frame halves are combined, the semi-annular recesses combine to form annular recesses that are dimensioned to capture a head of a swivel pin. Links of chain may then be used to link two handcuffs together. This construction method provides both axial and lateral flexibility. Alternatively, hinges may be used to join handcuffs into a pair of handcuffs. This construction method limits lateral flexibility. Alternatively, a rigid pair of handcuffs is described below that is stronger but thinner and lighter than prior art rigid handcuffs.

DETAILED DESCRIPTION OF THE INVENTION

Figure 1:
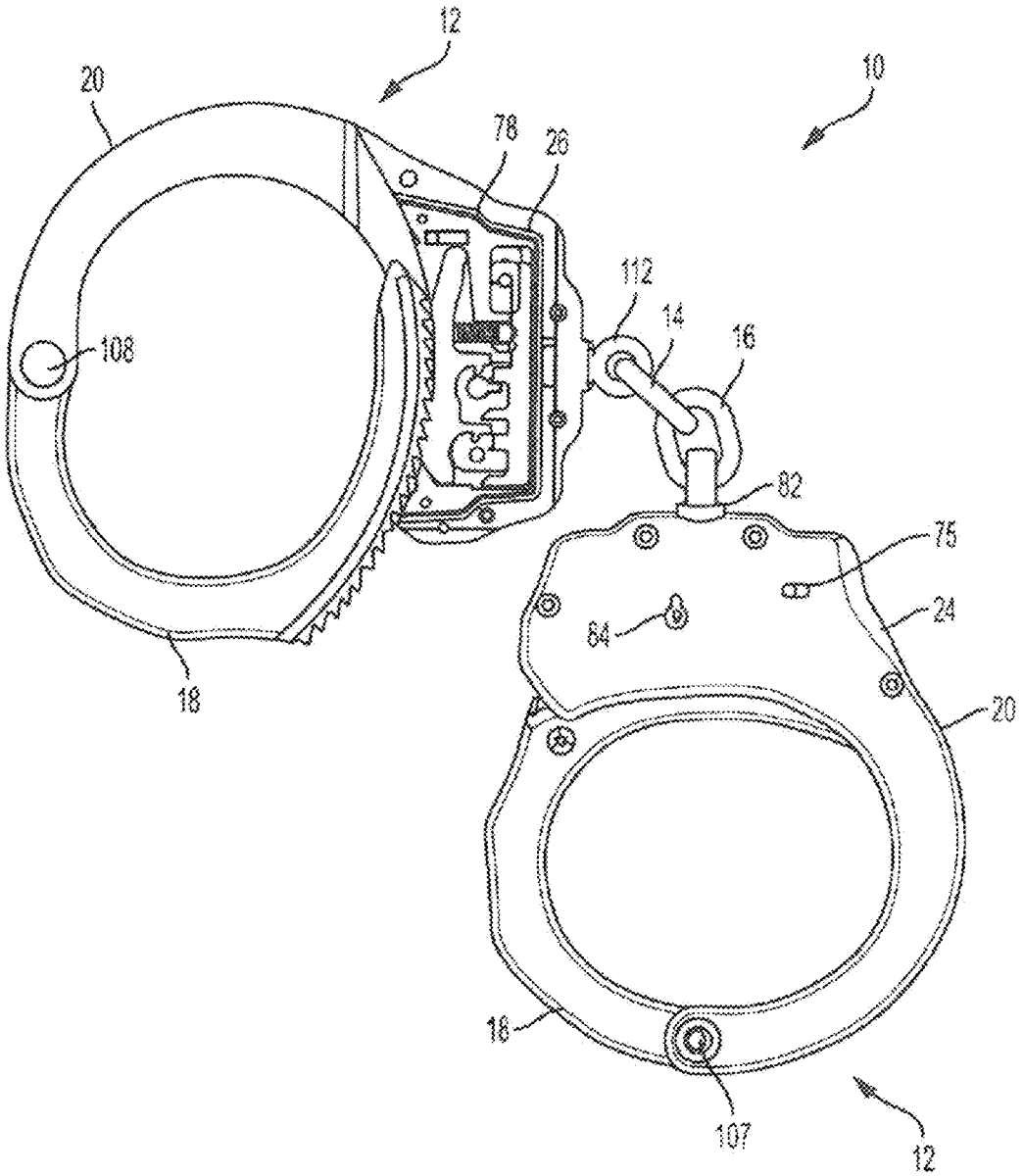
FIG. 1 is an illustration of one embodiment of handcuffs.
Figure 10A:
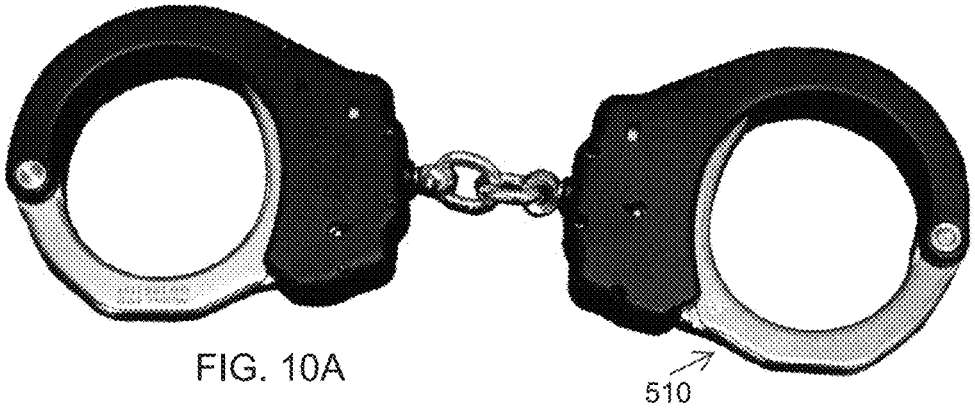
FIGS. 10A, 10B and 10C illustrate three alternative pairs of handcuffs, FIG. 10A showing a chain joining each one of a pair of handcuffs to each other as in FIG. 1, FIG. 10B showing hinges joining each one of a pair of handcuffs to each other, and FIG. 10C showing a rigid pair of handcuffs.
Figure 10B:
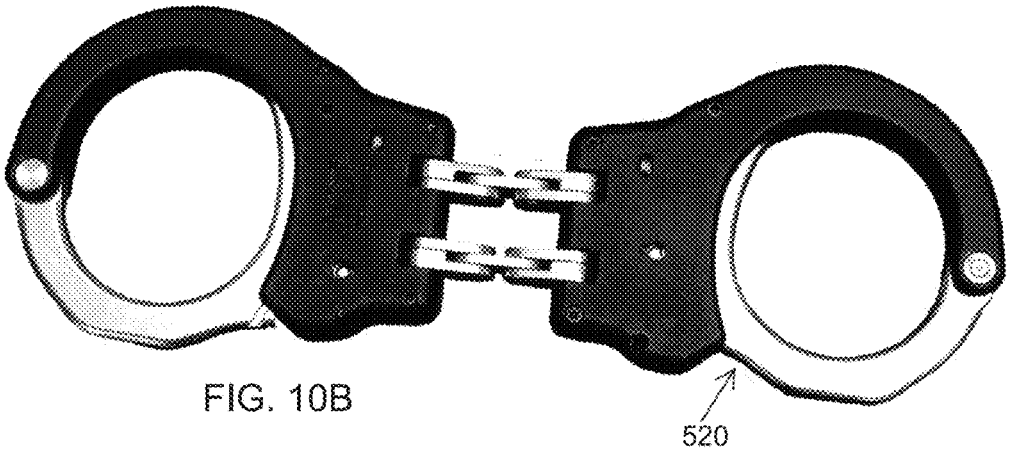
Figure 10C:
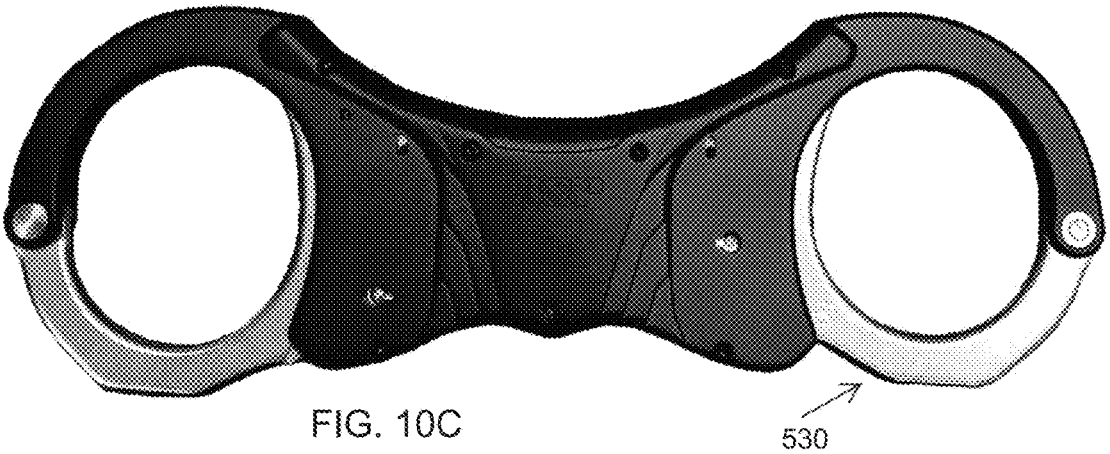

Referring now to the drawings in greater detail, there is illustrated in FIG. 1 a set of handcuffs 10 including two cuffs 12 linked together by two chain links 14 and 16. Although links are shown in this illustrative, non-limiting example, the present invention may also be used with hinged handcuffs and rigid handcuffs, as illustrated in FIGS. 10A-10C. FIG. 10A shows a chain joining each one of a pair of handcuffs 510 to each other as in FIG. 1. FIG. 10B shows hinges joining each one of a pair of handcuffs 520 to each other. FIG. 10C shows a rigid pair of handcuffs 530, described in more detail below.

Each cuff 12 comprises a bow 18, pivotally connected to a forged cheek plate assembly 20.

Figure 2:
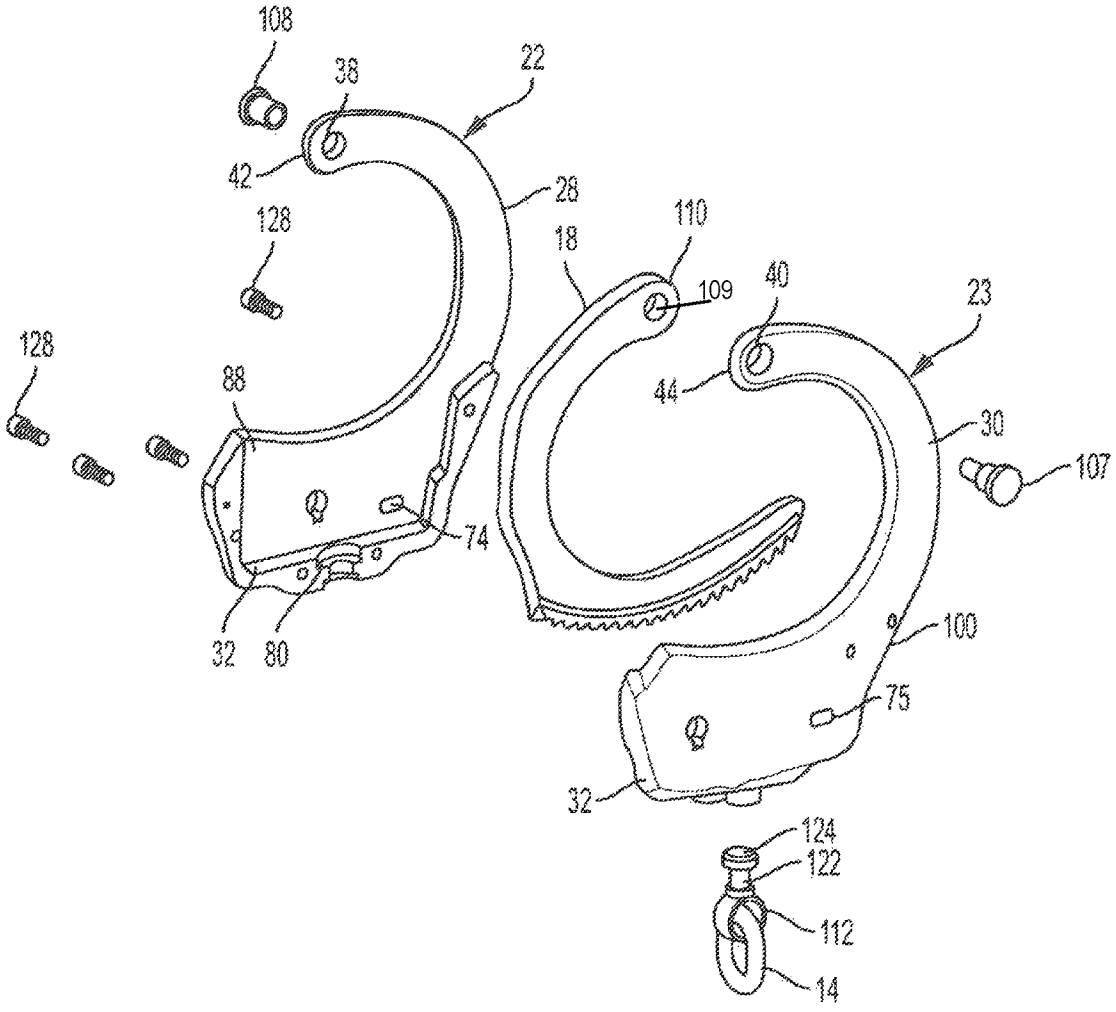
FIG. 2 is an exploded view illustration of one of the handcuffs of FIG. 1.
Figure 3:
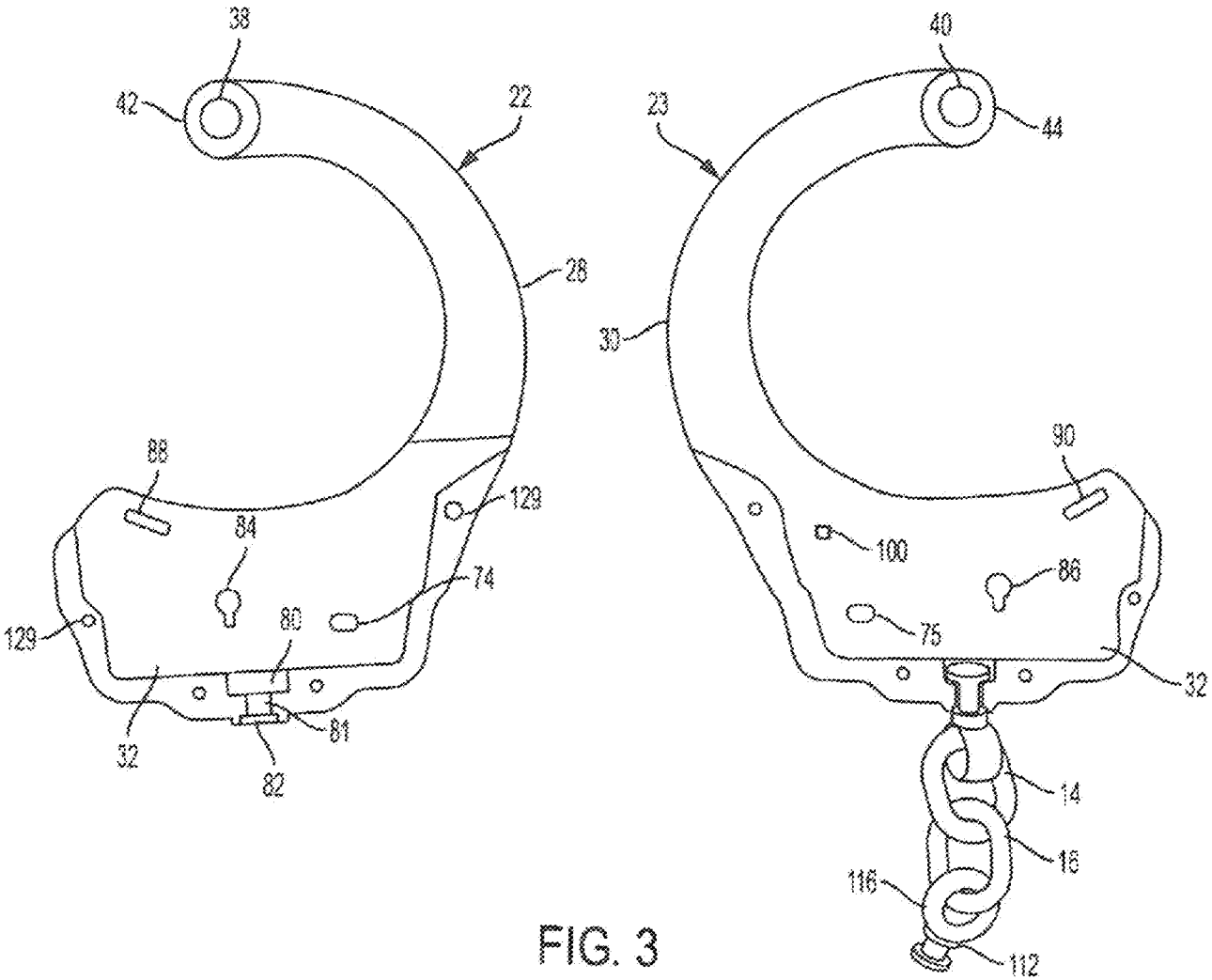
FIG. 3 is an illustration of cheek plate forgings of the handcuff of FIG. 2.

FIG. 2 illustrates cheek frame halves 22, 23. Cheek frame halves 22, 23 are assembled together to form a cheek plate frame assembly 24 including a lockset cavity 26 and parallel spaced cheek arms 28 and 30 as shown in FIG. 3. Each cheek frame half 22, 23 is forged, preferably from an aluminum alloy, such as 7075 aluminum. Such alloys are known for strength comparable to steel while maintaining light weight properties.

In a first step of the forging process, a round bar of 7075 aluminum alloy is bent into a U-shape to match the general shape of a finished cheek frame half. The bar of aluminum alloy is heated to a forging temperature. The forging temperature is a temperature at which a metal becomes substantially softer, but is lower than the melting temperature. For aluminum alloys, a forging temperature is in the range of 300-480 degrees Celsius.

The curved, heated bar is placed in a die providing the basic shape of the outer surface of a cheek plate half. A corresponding die provides the inner surface of a cheek plate half, and a press strikes the heated bar between the two dies, forging the bar to the shape defined by the dies. The forging is then allowed to cool, and is annealed to soften it. The forging is trimmed to shape with a stamping die that cuts the excess flash from the edges of the forging. The forging may then be heat treated for hardness.

The forging is machined to add all needed holes and detail required by the cheek plate half as described below. It is then sandblasted to give the surface a mat finish. The surface is hard coat anodized for durability and wear resistance.

The forging steps as set forth above provide for precision shaping of the cheek frame halves 22, 23 while avoiding undesirable brittleness associated with die casting aluminum components.

Each cheek frame half 22, 23 includes a lockset cavity portion 32. A hole 38 or 40 is machined through an outer end 42 or 44 of each cheek arm 28, 30 for facilitating pivotal mounting of the bow 18 to and between the cheek arms 28 and 30. Outer ends 42, 44 may also feature a raised surface facing inwards so that the bow 18 may pivot around the holes 38, 40, without rubbing on the cheek arms themselves.

Each lockset cavity portion 32 further includes an oval-shaped hole 74, 75 formed therein which, when the lockset cavity portions 32 of both cheek frame halves are combined, will form lockset cavity 26 including aligned, opposed double-lock slots 74 and 75 for mating with a locksetting slot 76 in a double lock bar 77 in a lockset assembly 78 described in greater detail hereinafter.

In one embodiment, each cheek frame half 22, 23 also includes a plurality of semi-annular recesses 80, 81 and 82 such that when the cheek frame halves 22, 23 are combined, the semi-annular recesses 80, 81 and 82 combine to form annular recesses that are dimensioned to capture a head of a swivel pin, as will be described in more detail below.

Axially spaced-apart keyway forming openings 84 and 86 are also formed in the cheek frame halves 22, 23, such that a key can be inserted through either one of these keyway forming openings 84, 86 from either side of the handcuff 12.

Also, two detents or track guides 88 and 90 are formed into the lockset cavity portions 32 for being received in a track groove 98 (FIG. 4) in the bow 18.

A latch hole or notch 100 is provided in one of the lockset cavity portions 32 in the illustrated embodiment in cheek frame half 23, for receiving a flexible detent 102 in/on a cover 103 for a housing shell 104 for a housing 105 of the lockset assembly 78 (FIG. 7) for latching the lockset assembly 78 in the lockset cavity 26 while permitting removal of the lockset assembly 78 from the lockset cavity 26 (illustrated in cut-away in FIG. 1).

In FIG. 2 a stainless steel pivot pin 107 and a stainless steel pivot bushing 108 are positioned for insertion through holes 38 and 40 in the cheek arms 28 and 30 and a hole 109 in a base end 110 of the bow 18. The pin 107 is swaged, staked or riveted in place.

In the embodiment of FIG. 2, a swivel pin 112 is shown mounted by a swivel eyelet 116 on the chain link 14 positioned for capture in the recesses 80, 81, 82 of the cheek plate halves 22, 23.

The eyelet portion 116 of the swivel 114 is first received on the chain link 14 or 16 and then the swivel pin 112 is received in semi-annular recesses 80, 81, 82 of one of the cheek frame halves 22, 23. Here it will be seen that recess 80 is dimensioned to accept end portion 124 of swivel pin 112, and that recess 81 is reduced in radius relative to recess 80 to accommodate neck portion 122 and capture end portion 124. Recess 82 may optionally be included to provide additional support to swivel pin 112. A low friction bearing type relationship is thereby established between the swivel pin 112 and the recesses 80, 81, 82 thereby to enable the swivel pin 112 to swivel easily with respect to the cheek frame halves 22, 23 much like a shaft in a bearing.

The cheek arms 28 and 30 are positioned to be parallel and spaced from each other as shown. The cheek frame halves 22, 23 are assembled together (capturing end portion 124 of swivel pin 112) using spiral pins 128 passing through apertures 129 in cheek frame half 22 and into threads tapped into corresponding apertures in cheek frame half 23. The spiral pins 128 are heat treated for strength and may have tamper-resistant heads. The threads may be treated with thread locking compound prior to assembly. For example, Loctite® brand Red Threadlocker, when cured, requires application of heat to the threads to be disassembled, thereby preventing and/or discouraging attempted disassembly while the handcuffs are being worn by a person. The use of such fastening means allows for secure assembly in use, but also for disassembly for repair, such as if a swivel eye or linking chain is damaged and requires replacement. Rivets may also be used to assemble cheek frame halves 22, 23.

Advantageously, impression die forging allows for the cheek frame halves 22, 23 to be fabricated with radiused, curved, rounded, or beveled edges integrally formed during manufacture of the cheek frame halves, without the necessity of separate steps such as post-forging machining or plastic over-molding. The curved, rounded edges are desirable to minimize potential injury to a wrist from the cheek plate assembly 20. Further, the forging process allows the double-lock slots 74, 75 and the keyway openings 84, 86 to be beveled on each side of the lockset cavity 26.

The bow 18 is preferably formed from stainless steel powder which is sintered, i.e., first subjected to pressure in a mold and second, subjected to heat. Just prior to application of high pressure, some of the metal powder is removed so that rounded edges of 0.040-0.120 inch can be formed, preferably about 0.080 inch. In this way, the bow 18 is made with rounded inner edges 132 (FIG. 9) for presenting minimal trauma to the wrist of a person being restrained.

Figure 4:
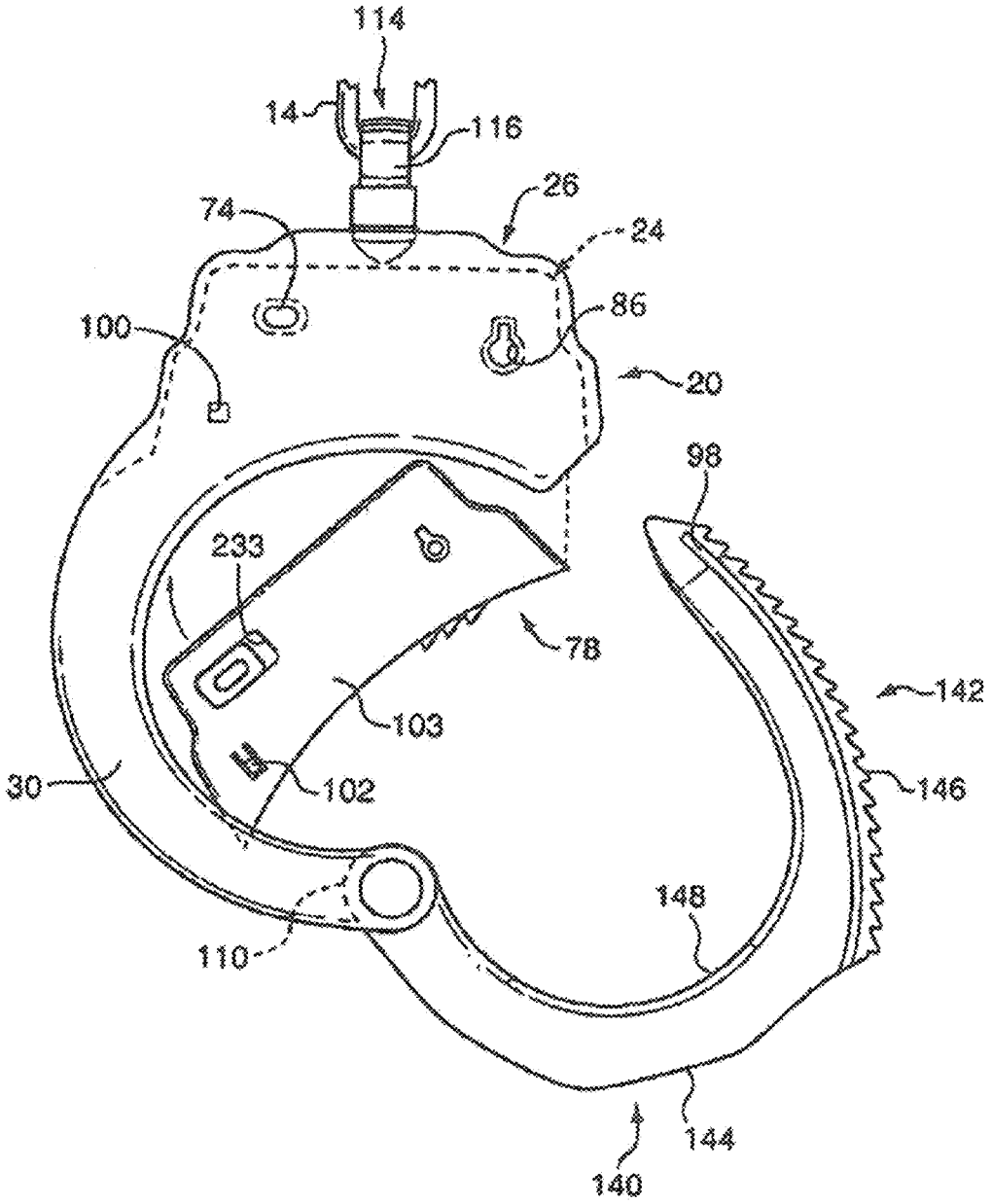
FIG. 4 is an illustration of another aspect of the handcuff of FIG. 2.

Referring to FIG. 4, the bow 18 includes a first arcuate or curved portion 140 and a second arcuate or curved portion 142 defining a tooth track portion. The first arcuate portion 140 includes the base end 110 with hole 109 therein and has an outer, high contact, flat face 144 which is designed to be applied against the edge of a wrist for pushing the bow 18 through the cheek plate assembly 20 and come full circle about the pivot pin 107 and about a wrist. The second arcuate portion 142 defines a tooth track portion 142 and has spaced, wide, deep set, ratchet teeth 146 formed on an outer side thereof. The tooth track portion 142 is also formed with the arcuate track groove 98 on either side thereof.

Further, the bow 18 may be polymer infused to inhibit, if not altogether prevent rust or corrosion of the bow 18 and to inhibit, if not to altogether prevent, absorption of body fluids from the wrist of a person being restrained into the bow 18.

Additionally, the envelope formed on an inner edge surface 148 of the bow starting from the base end 110 and extending to the pointed outer end 136 of the bow 18 is formed according to a conic path having an increasing arc so as to form an envelope adapted to receive various sized wrists at different positions of the bow 18 relative to the cheek plates or arms 28, 30 of the cheek plate assembly 20 and with a minimum of pressure applied to the wrist. Stated otherwise the conic path of the surface 148 is a curve generated by a projection of a portion of a conic onto a flat plane. The software for generating the design of this conic path is sold by Parametric Technologies Corporation of Needham, Mass. under their trademark, Pro/ENGINEER 3-D.

Again, it will be understood that the envelope of the inner edges of the cheek plate arms 28, 30 going from the outer ends 42 and 44 having the pivot pin mounting holes 38 and 40 to the entry point between the corners of the lockset cavity 26, also follows a similar or the same conic path having an increasing arc.

Figure 7:
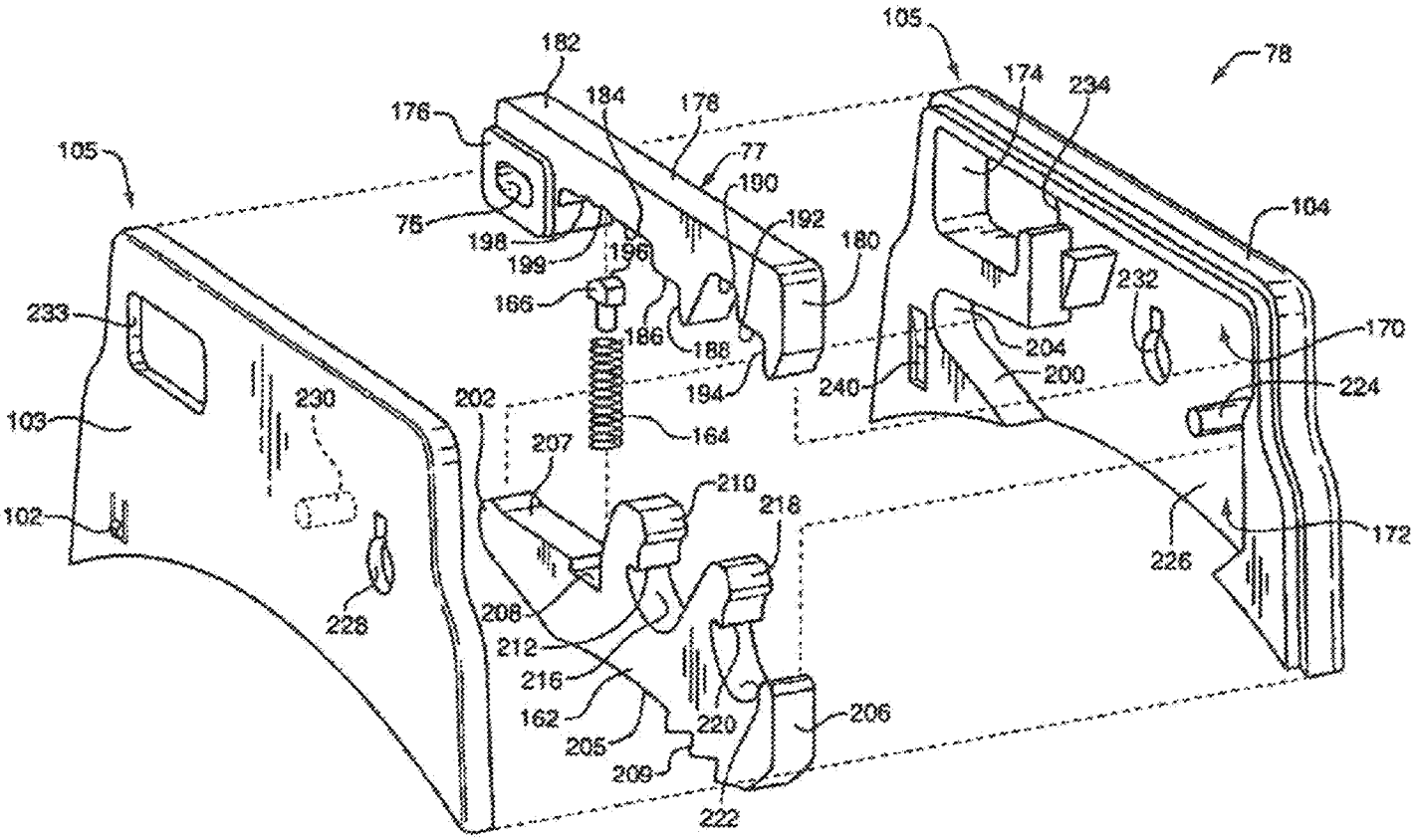
FIG. 7 illustrates an exploded view of a lockset assembly which is useful in connection with a handcuff.
Figure 9:
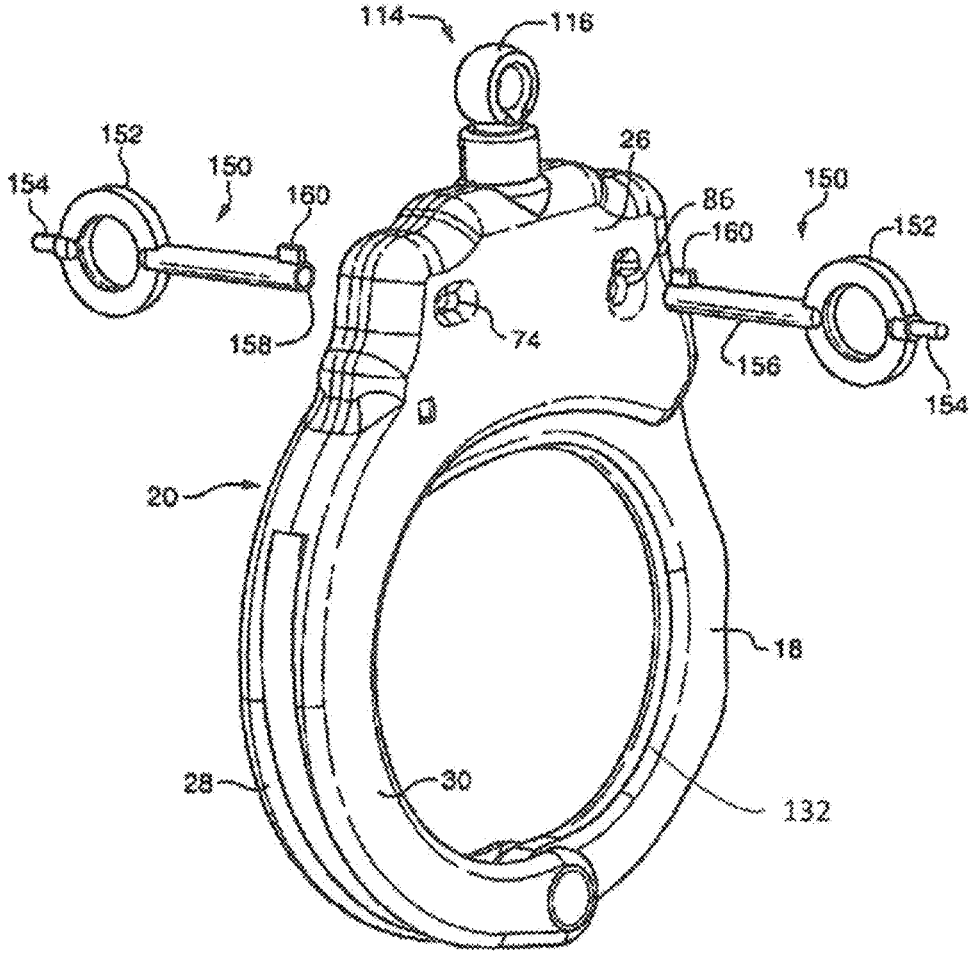
FIG. 9 illustrates dual keyways which may be implemented in a handcuff.

Referring now to FIG. 7, there is illustrated therein the components of the replaceable lockset assembly 78. The lockset assembly 78 shown in FIG. 7 is constructed for use with conventional handcuff key 150 as shown in FIG. 9. Such a key 150 includes a ring-shaped handle 152 having a short actuating end pin 154 extending rearwardly therefrom and a shaft 156 extending forwardly therefrom to an outer, hollow cylindrical end 158. On the other surface of the outer cylindrical end 158 is a single, generally rectangularly shaped, tooth 160. This key 150 is generally standard for use in opening handcuffs and is adapted to be inserted into a keyway in a handcuff and rotated to lock and unlock the handcuff.

The rearwardly extending pin 154 is used to set the position of a double lock bar 77 in a lockset assembly, as will be explained in greater detail hereinafter.

Referring again to FIG. 7, the lockset assembly 78 includes the housing 105 (which is shown exploded in two parts in FIG. 7) that includes the housing shell 104 and the housing cover 103. Inside the housing 105, there is positioned the double lock bar 77, a double lock bar pawl 162, a lock spring 164 and spring tip 166.

The housing shell 104 includes an upper cavity portion 170 and a lower cavity portion 172. The upper cavity portion 170 includes a rounded, generally rectangular shaped section 174 for receiving a generally rectangular-shaped block end 176 of the double lock bar 77. The rectangular-shaped block end 176 has the generally oval lock setting slot 76 extending therethrough for receiving the short actuating pin 154 on the key 150 from either side of the lockset assembly 78. The pin is moved laterally in the slot 76 to move the end 176 and thereby the double lock bar 77 between a single lock position and a double lock position described in greater detail hereinafter.

The double lock bar 77 further includes a bar portion 178 that extends from the generally rectangular shaped end 176 to an opposite end 180—of the double lock bar 77. An upper side surface 182 and a side surface (hidden from view) of the bar portion 178 are smooth for facilitating sliding movement adjacent wall surfaces of the housing shell 104. Preferably the double lock bar is made of plastic and colored with a high visibility color, so that the end 176 with slot 76 easily can be seen through the double lock slots 74 and 75 in the lockset cavity 26.

Then, on the lower side of the double lock bar 77 and spaced a short distance from the generally rectangular end 176, there is provided a first space or cavity area 184, then a first step or land 186 followed by a first shoulder 188 going in a direction toward the end 180. Continuing toward the end 180 there is next provided a second space or cavity area 190, a second step or land 192 and a second shoulder 194 adjacent the end 180 of the double lock bar 77.

The lock spring tip 166 has an upper wedge shape tip 196 which is movable between two depressions or shallow V-shaped notches 198 and 199 located in the lower side of the double lock bar 77 between the rectangular block end 176 and the first space or cavity area 184, when the double lock bar 77 is moved between a single lock position and a double lock position to latch releasably the double lock bar 77 in either position. When the double lock bar 77 is moved between the two lock positions the spring 164 is compressed slightly as the wedge shape tip 196 snap-fittingly moves between the depressions or V-shaped notches 198 and 199.

The lower cavity portion 172 of the housing shell 104 has a rounded V-shaped cavity portion 200 into which a rounded end 202 of the double lock bar pawl 162 extends. This end 202 is rounded for pivoting on a rounded end wall 204 of the rounded V-shaped cavity portion 200. An opposite end 206 of the double lock bar pawl 162 is shaped to fit within the lower cavity portion 172 and is arranged for swinging movement within the lower cavity portion 172 about the opposite pivot end 202 of the double lock bar pawl 162.

An outer side 205 of the pawl 162 has a plurality of, typically three, teeth 209 which are constructed, sized and arranged to be received between and mesh with the teeth 146 on the outside of the tooth track portion 142 of the bow 18. On the other or inner side 207 of the double lock bar pawl 162 is a notch 208 for receiving the lock spring 164. The notch 208 is spaced from the rounded end 202. Then, extending from the inner side 207 of the pawl 162 and toward the lock bar 77 is a first leg 210 which, when the double lock bar 77 is positioned to the right, is positioned opposite the first space or cavity 184 in the double lock bar 77. When the double lock bar 77 is positioned to the left, the first leg 210 is positioned opposite to and adjacent the first step or land 184 on the double lock bar 77. The first leg has a block end and a curved side that extends to a first ledge 212 that faces back toward the bow 18. Then, a first actuate surface 216 extends from the first ledge 212 in an arcuate path to a second leg 218 which extends away from the inner side 207 of the pawl 162 and toward the double lock bar 77. This second leg 218 also has a block end and a curved side which extends to a second ledge 220. Extending from the second ledge 220 is a second arcuate surface 222 that extends in an arcuate path to the end 206. The first arcuate surface 216 and the second arcuate surface 222 are adapted to interact with the tooth 160 on the key 150 when the key 150 is inserted into the lockset assembly 78.

As shown in FIG. 7, the housing shell 104 has a pin 224 extending from an inner wall surface 226 that extends along a first axis in line with a keyway 228 in the housing cover 103. Then, parallel spaced to this pin 224 is another pin 230 that extends from an inner wall surface of the housing cover 103 toward the housing shell 104 along a second axis which is aligned with a keyway 232 in the wall of the housing shell 104. The keyways 228 and 232 are arranged to be aligned with the keyways 86 and 84 of the lockset cavity 26.

It will be understood that the key 150 can be inserted through either keyway 232 or 228 with the hollow circular end 158 of the key 150 then being received over the pin 230 or the pin 224 and with the tooth 160 positioned adjacent the first arcuate surface 216 or second arcuate surface 222 of the double lock bar pawl 162.

A double lock slot 233 is provided in the wall of the housing cover 103 in line with the generally rectangular rounded cavity 174 in the housing shell 104. The housing shell is provided with a similar double lock slot 234. Both double lock slots 233 and 234 are in line with the rectangular end 176 and with the double lock slots 74 and 75 in the lockset cavity 26. The aligned slots 74, 233, 234 and 75 permit the actuating pin 154 on the key 150 to be inserted from either side of the lockset cavity 26 into the lockset assembly 78 for engaging, one side of the locksetting slot 76 in the double lock bar 77 for moving the double lock bar 77 from a single lock position to a double lock position as will be described in greater detail hereinafter.

Figure 8:
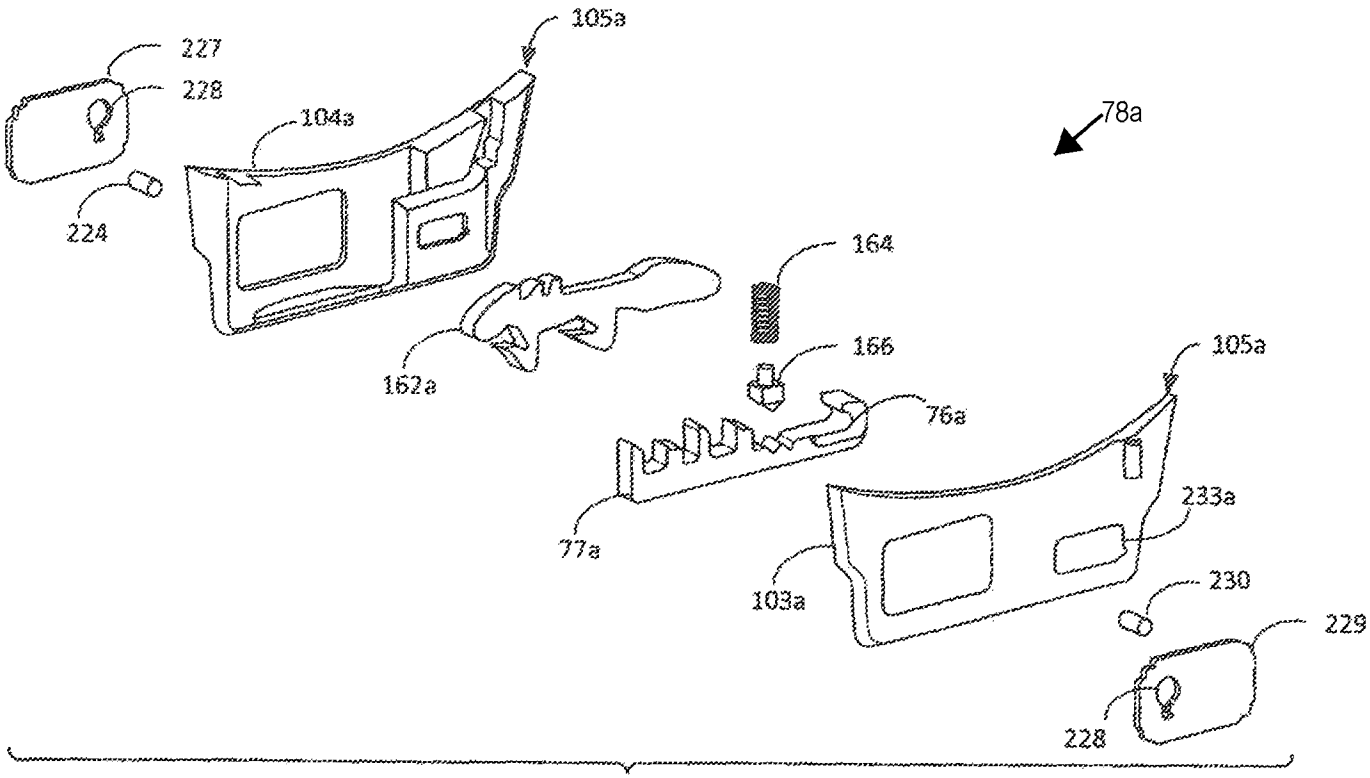
FIG. 8 illustrates an exploded view of an alternate construction of a lockset assembly which is useful in connection with a handcuff.

FIG. 8 illustrates an alternate construction of replaceable lockset assembly 78*a*. Operation is the same as described with respect to lockset assembly 78 of FIG. 7.

Housing 105*a* comprises housing shell 104*a* and housing cover 103*a*. Housing shell 104*a* and housing shell 103*a* may be formed from an injection molded polymer and ultrasonically welded to form housing 105*a*. Keyway plates 227 and 229 are metal and are fixed into opposing location on housing shell 104*a* and housing cover 103*a* respectively. Keyway plates 227 each include a keyway 228. Pin 224 is fixed to keyway plate 227 and pin 230 is fixed to keyway plate 229. Double lock bar pawl 162*a*, lockspring 164, springtip 166 and double lock bar 77*a* are arranged and operate similarly to their corresponding components in lockset assembly 78 (FIG. 7).

Figure 5:
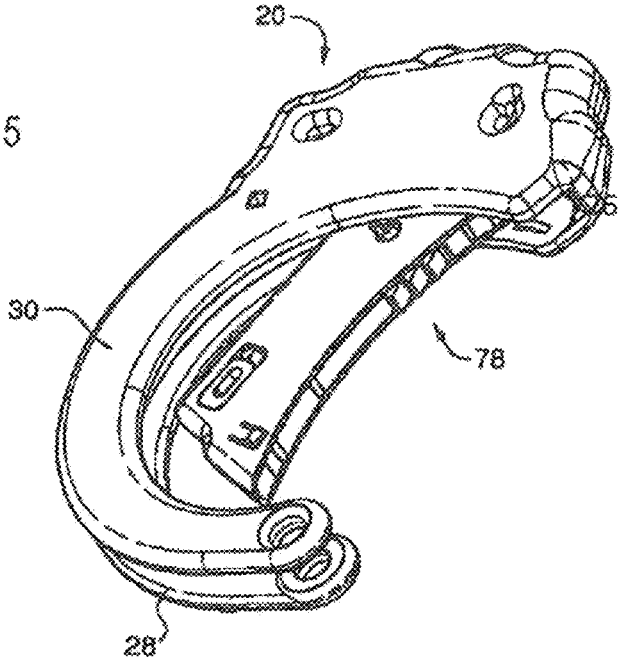
FIGS. 5 and 6 illustrate insertion of a lockset assembly into a handcuff.
Figure 6:
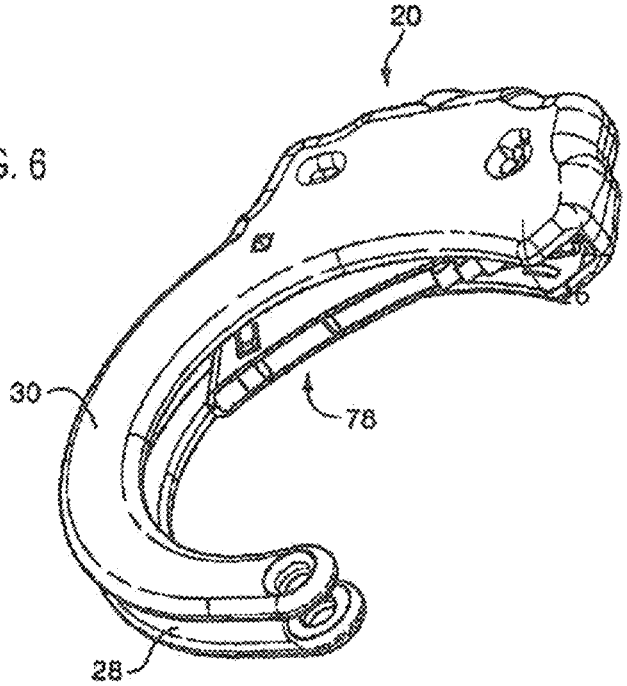

Referring now to FIGS. 5 and 6, it will be seen that the assembled lockset assembly 78 is pivotally inserted into the hollow interior of the lockset cavity 26 and rotated into and moved linearly into the hollow interior of the lockset cavity 26 until the deflectable detent 102 is snap fittingly received into the latching notch 100 in a lockset cavity portion 32 of the lockset cavity 26. The progressive movement of the lockset assembly 78 into the lockset cavity 26 is shown in FIGS. 5 and 6.

Operation of the lockset assembly 78 is described and illustrated in more detail in U.S. Pat. No. 7,062,943, which is incorporated by reference.

Whenever the lockset assembly 78 ceases to function properly, it will be understood that the lockset assembly 78 can be disengaged from its position within the hollow interior of the lockset cavity 26 by inserting a tool (such as an awl or screwdriver) into the lockset cavity 26 from a position outside of and into and between the cheek arms 28 and 30 and at the same time depress the deflectable detent 102 out of the latching notch 100 and into a recess 240 for this purpose formed in the inner wall surface 226 of the housing shell 104 and pry the lockset assembly 78 out of the lockset cavity 26 to replace the same. This will be done in steps starting with the position of the lockset assembly 78 inside the lockset cavity 26 and then going to the position shown in FIG. 6 and then the position shown in FIG. 5 and then finally to the fully released position shown in FIG. 4.

FIG. 9 illustrates another important feature of the handcuffs 10, namely the ability to insert a key 150 from either side of the handcuff 12 into the lockset cavity 26 for engagement with the double lock bar 77 and pawl 162 inside the lockset assembly 78.

As best shown in FIG. 3, the track guides or detents 88, 90 have a rounded configuration for facilitating engagement with the track grooves 98 and facilitate guiding of the bow 18 between cheek frame halves 22, 23 of the lockset cavity 26 and thereby through and between the cheek plate arms 28 and 30.

From the foregoing description, it will be understood that the pair of handcuffs 10 and the individual handcuffs 12 thereof have a number of advantageous features some of which have been described above and others of which are inherent in the invention.

The lockset assembly is removable to enable a damaged or non-functioning lockset assembly to be replaced without requiring a complete replacement of the set of handcuffs. The lockset assembly provides a simple lock mechanism with a lock bar having a locksetting slot which can be manipulated by an actuating pin on a conventional handcuff key or by the conventional handcuff key for putting the lock mechanism in a double or single lock position. Then two keyways are provided on either side of the lockset cavity to enable a key to be inserted into the handcuff from either side of the handcuff.

Figure 11B:
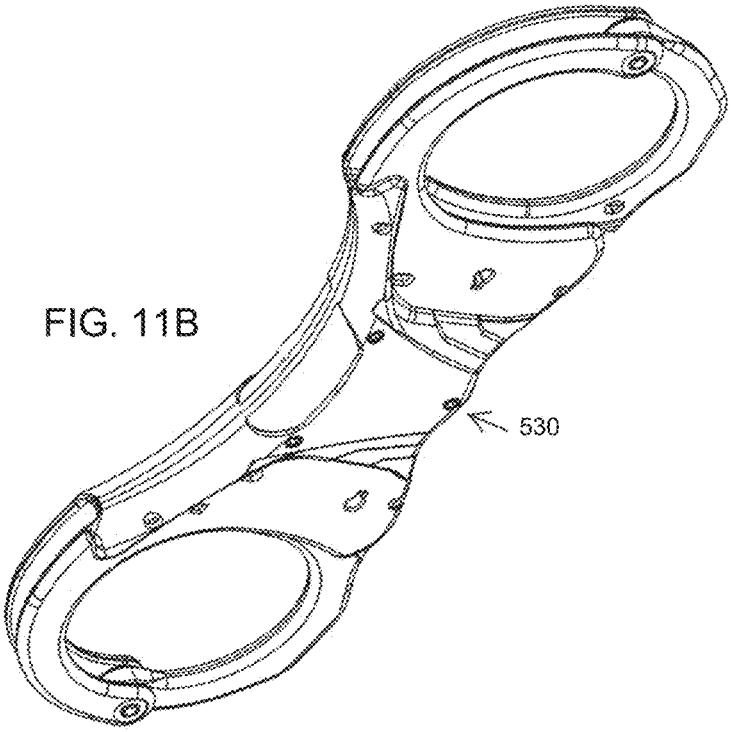
FIGS. 11A and 11B illustrate two perspective views of a first side of a rigid pair of handcuffs.
Figure 11A:
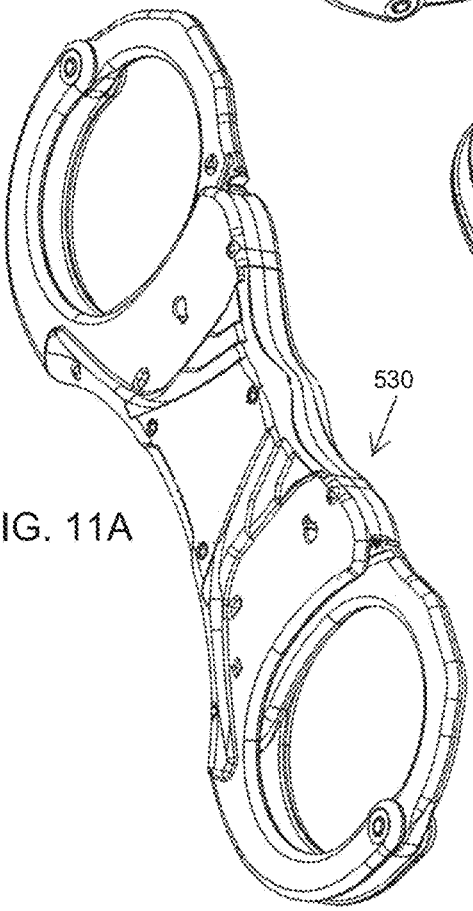
Figure 11C:
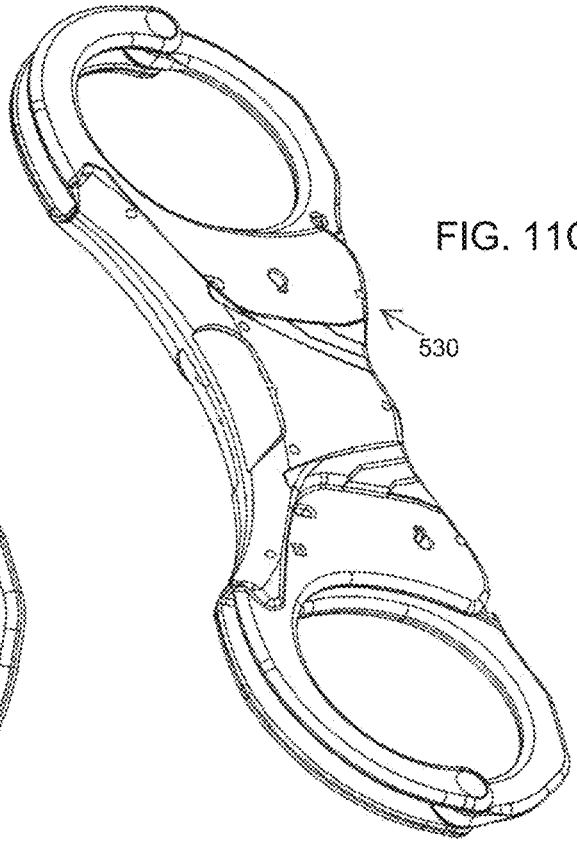
FIG. 11C illustrates a perspective view of the second side.
Figure 12B:
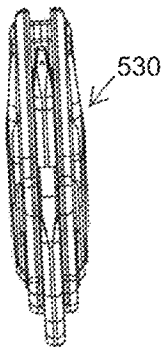
FIGS. 12A, 12B, 12C and 12D illustrate first side, end, bottom and second side views of the rigid pair of handcuffs of FIGS. 11A-11C.
Figure 12A:
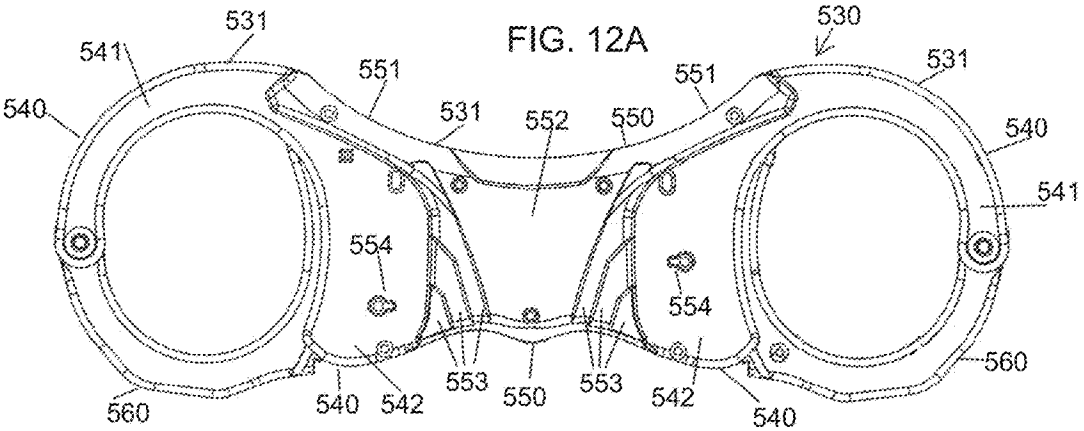
Figure 12C:
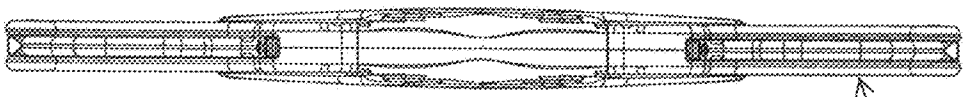
Figure 12D:
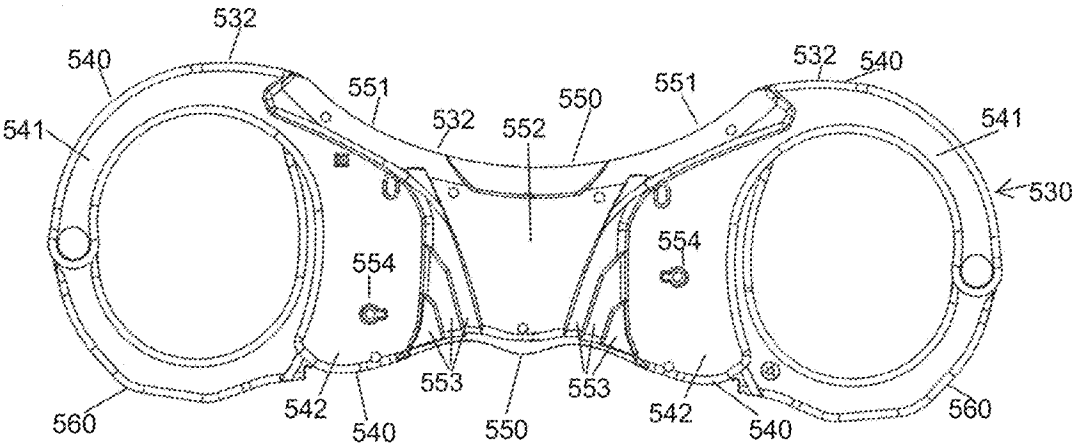
Figure 13:
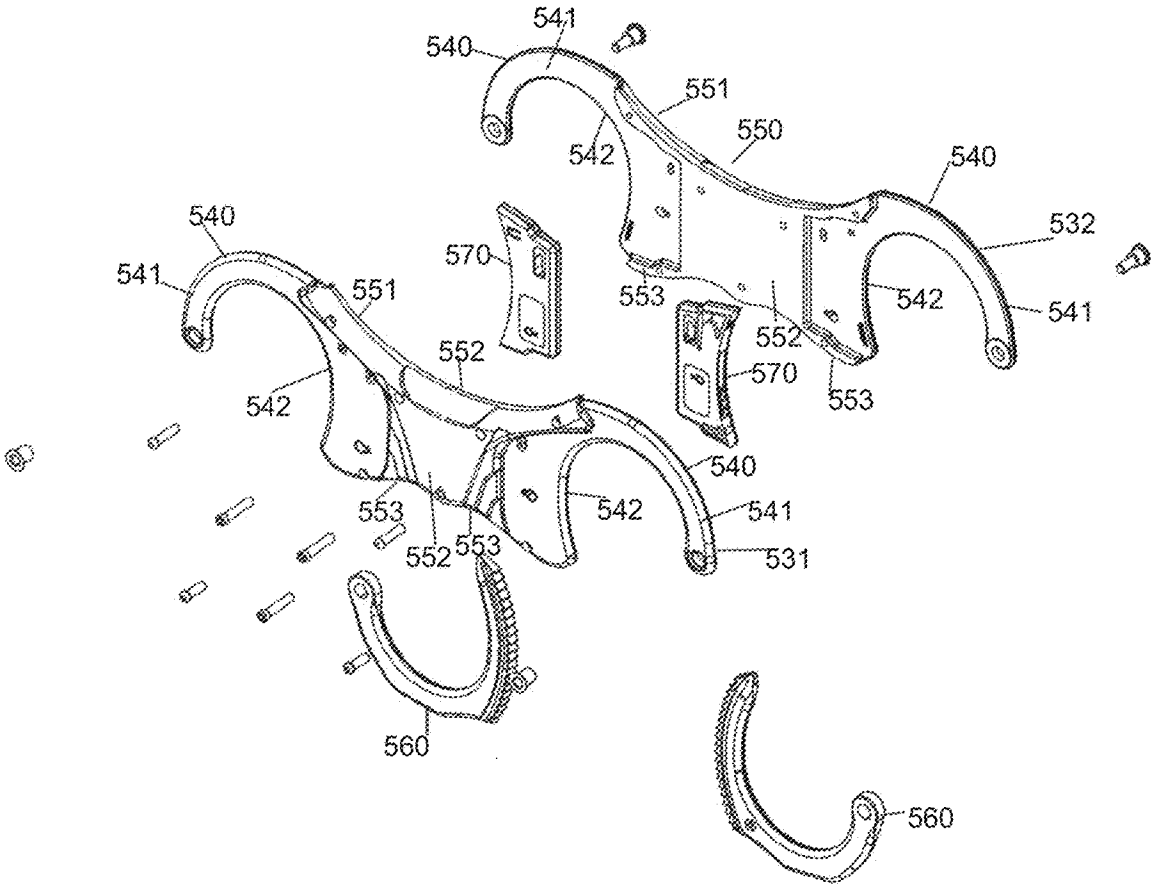
FIG. 13 is an exploded view of the rigid pair of handcuffs of FIGS. 11A-11C.

FIGS. 11A-13 illustrate an embodiment of a rigid pair of handcuffs 530 that can incorporate other features described above. FIGS. 11A and 11B illustrate two perspective views of a first side of rigid pair of handcuffs 530, and FIG. 11C illustrates a perspective view of the second side of rigid pair of handcuffs 530. FIGS. 12A, 12B, 12C and 12D illustrate first side, end, bottom and second side views of the rigid pair of handcuffs 530 of FIGS. 11A-11C. FIG. 13 is an exploded view of the rigid pair of handcuffs 530 of FIGS. 11A-11C.

The rigid pair of handcuffs 530 comprises a first side plate 531, a second side plate 532, two bows 560 (one for each of the handcuffs), and two lockset assemblies 570 (one for each of the handcuffs). FIG. 12A shows an outside view of first side plate 531, FIG. 12D shows an outside view of second side plate 532, and FIG. 13 shows an outside view of first side plate 531 and an inside view of second side plate 532.

As best seen in FIGS. 12A, 12D and 13, the first side plate 531 comprises a cheek frame half 540 of each one of the two handcuffs, and a middle section 550. Each of the cheek frame halves 540 comprises a cheek arm 541 and a lockset cavity portion 542. Each of the cheek frame halves 540 is integral with the middle section 550 on opposing ends of the middle section, respectively. That is, the first side plate 531 is preferably a single forged component, which simplifies the manufacturing process.

Similarly, the second side plate 532 also comprises a cheek frame half 540 of each one of the two handcuffs, and a middle section 550. Each of the cheek frame halves 540 comprises a cheek arm 541 and a lockset cavity portion 542. Each of the cheek frame halves 540 is integral with the middle section 550 on opposing ends of the middle section 550, respectively. That is, the second side plate 532 is preferably a single forged component, which simplifies the manufacturing process.

The first and second side plates 531 and 532 are preferably forged from an aluminum alloy, such as 7075 aluminum. The cheek frame halves 540 are similar to those in embodiments described above. When the first and second side plates 531 and 532 are assembled together, the counterpart lockset cavity portions 542 combine to form a lockset cavity for each one of the two handcuffs, for receipt of lockset assemblies 570. Similarly, when the first and second side plates 531 and 532 are assembled together, the counterpart cheek arms 541 of each one of the two handcuffs are parallel and spaced apart from each other for receipt of a bow 560 that is pivotally attached to a peripheral end of the cheek arms 541.

In preferred embodiments, each middle section 550 comprises a top portion 551 adjoining the lockset cavity portions 542 (for each one of the two handcuffs) on opposing ends of the top portion 551, respectively. Each middle section 550 comprises layered portions 553 also adjoining the lockset cavity portions 542 (for each one of the two handcuffs), respectively. Each middle section 550 comprises a middle portion 552 adjoining the top portion 551 and the layered portions 553.

The layered portions 553 are reinforced layers of different thicknesses, which are sturdy and not susceptible to bending where prior art versions of rigid pairs of handcuffs are often weakest. The rigid pair of handcuffs 530, with the forged aluminum side plates 531 and 532, is thinner and lighter, but stronger, than prior art versions of rigid pairs of handcuffs.

As illustrated in the figures, including FIGS. 12A and 12D, two first-side keyways 554 can be disposed in each of the first and second side plates 531 and 532. Each keyway 554 is aligned for receiving a key in the lockset assembly 570 of one of two handcuffs. Consequently, each of the two handcuffs can be unlocked using a key inserted through either the first side plate 531 or the second side plate 532.

Further, it will be understood that the sets of handcuffs of the present invention can be modified without departing from the teachings of the invention. Accordingly, the scope of the invention is only to be limited as necessitated by the accompanying claims.

What is claimed is:

1. A handcuff, comprising:

a first forged cheek frame half including a first cheek arm and a first lockset cavity portion, the first forged cheek frame half being at least part of a single integral first forged aluminum alloy component;

a second forged cheek frame half including a second cheek arm and a second lockset cavity portion, the second forged cheek frame half being at least part of a single integral second forged aluminum alloy component that is a different component than the first forged aluminum alloy component;

the first and second forged cheek frame halves being joined directly to each other, so that said first lockset cavity portion and said second lockset cavity portion combine to form a lockset cavity between the first and second cheek frame halves;

a bow having outwardly facing teeth along a portion of the bow and being rotatably fastened to the first and second cheek arms; and a removable lockset assembly disposed within the lockset cavity, the lockset assembly comprising a movable pawl corresponding to the teeth, wherein the pawl releasably engages the teeth when the bow is rotated into engagement with the lockset assembly.

2. The handcuff of claim 1, wherein each forged cheek frame half is die forged from a bar of 7075 aluminum alloy.

3. The handcuff of claim 1, wherein each forged cheek frame half is hard coat anodized forged aluminum alloy.

4. The handcuff of claim 1, wherein the first forged cheek frame half is fastened to the second forged cheek frame half with a plurality of spiral pins.

5. The handcuff of claim 4, wherein the spiral pins are set in threadlocking compound.

6. The handcuff of claim 1, wherein the first and second forged cheek frame halves further comprise a plurality of semi-annular recesses such that when the first and second forged cheek frame halves are combined, the semi-annular recesses combine to form annular recesses that are dimensioned to capture an end portion of a swivel pin.

7. A pair of handcuffs, each one of the pair of handcuffs being the handcuff of claim 6, the pair of handcuffs further comprising:

a pair of swivel pins, an end portion of each one of the pair of swivel pins being captured in the annular recesses of one of the pair of handcuffs, respectively;

a chain with at least one chain link, the chain joining each one of the pair of handcuffs to each other, an eyelet portion of each one of the pair of swivel pins being received on the chain.

8. A pair of handcuffs, each one of the pair of handcuffs being the handcuff of claim 1, the pair of handcuffs further comprising: at least one hinge joining each one of the pair of handcuffs to each other.

9. A pair of rigid handcuffs, each one of the pair of rigid handcuffs being the handcuff of claim 1, wherein the pair of rigid handcuffs comprises a first side plate and a second side plate;

the first side plate being the single integral first forged aluminum alloy component;

the first side plate comprises the first cheek frame half of each one of the pair of rigid handcuffs and a first middle section, the first cheek frame half of each one of the pair of rigid handcuffs being integral with the first middle section on opposing ends of the first middle section, respectively;

the second side plate being the single integral second forged aluminum alloy component; and the second side plate comprises the second cheek frame half of each one of the pair of rigid handcuffs and a second middle section, the second cheek frame half of each one of the pair of rigid handcuffs being integral with the second middle section on opposing ends of the second middle section, respectively.

10. The pair of rigid handcuffs of claim 9, wherein the first middle section comprises:

a first top portion adjoining the first lockset cavity portion of each one of the pair of rigid handcuffs;

first layered portions adjoining the first lockset cavity portion of each one of the pair of rigid handcuffs, the first layered portions comprising a plurality of reinforced layers of different thicknesses; and a first middle portion adjoining the first top portion and the first layered portions; and the second middle section comprises:

a second top portion adjoining the second lockset cavity portion of each one of the pair of rigid handcuffs;

second layered portions adjoining the second lockset cavity portion of each one of the pair of rigid handcuffs, the second layered portions comprising a plurality of reinforced layers of different thicknesses; and a second middle portion adjoining the second top portion and the second layered portions.

11. The pair of rigid handcuffs of claim 9, wherein at least one of the first and second middle sections comprises layered portions, the layered portions comprising a plurality of reinforced layers of different thicknesses.

12. The pair of rigid handcuffs of claim 9, wherein two first-side keyways are disposed in the first side plate, each one of the two first-side keyways being aligned for receiving a key in the lockset assembly of one of the pair of rigid handcuffs, respectively; and two second-side keyways are disposed in the second side plate, each one of the two second-side keyways being aligned for receiving a key in the lockset assembly of one of the pair of rigid handcuffs, respectively.

* * * * *